US011103018B1

(12) United States Patent
Upshaw

(10) Patent No.: US 11,103,018 B1
(45) Date of Patent: Aug. 31, 2021

(54) MULTIFUNCTIONAL ATHLETIC APPAREL

(71) Applicant: Bonita Upshaw, Natchez, MS (US)

(72) Inventor: Bonita Upshaw, Natchez, MS (US)

( * ) Notice: Subject to any disclaimer, the term of this patent is extended or adjusted under 35 U.S.C. 154(b) by 242 days.

(21) Appl. No.: 16/363,699

(22) Filed: Mar. 25, 2019

(51) Int. Cl.

| | |
|---|---|
| ***A41D 15/04*** | (2006.01) |
| ***A41D 17/02*** | (2006.01) |
| ***A41D 1/04*** | (2006.01) |
| ***A41D 15/00*** | (2006.01) |

(52) U.S. Cl.
CPC ..... *A41D 15/04* (2013.01); *A41D 1/04* (2013.01); *A41D 15/002* (2013.01); *A41D 17/02* (2013.01); *A41D 2400/42* (2013.01); *A41D 2400/422* (2013.01); *A41D 2400/424* (2013.01)

(58) Field of Classification Search
CPC ..... A41D 15/04; A41D 15/002; A41D 17/02; A41D 1/04; A41D 2400/424; A41D 2400/42; A41D 2400/422; A41D 1/08; A41D 2400/38; A41B 11/08; A41B 11/04; A41B 11/12
See application file for complete search history.

(56) References Cited

U.S. PATENT DOCUMENTS 4,502,154 A * 3/1985 Itoi ..... A41D 3/00 2/108
5,040,243 A * 8/1991 Tatsuno ..... A41D 3/00 2/108
5,452,476 A * 9/1995 Jenks ..... A41D 3/00 2/108
5,564,125 A * 10/1996 Waldman ..... A41D 3/00 2/93
7,651,016 B2 1/2010 Stewart
10,477,905 B1 * 11/2019 Sachs ..... A41D 3/005
2002/0095710 A1 7/2002 Lee
2005/0198723 A1 * 9/2005 Green, III ..... A45F 4/12 2/93
2009/0205096 A1 * 8/2009 Seemann ..... A45F 3/14 2/4
2009/0241235 A1 * 10/2009 Weinreb ..... A45F 4/12 2/84
2013/0184622 A1 * 7/2013 Farrow ..... A61F 13/00 601/149
2013/0212772 A1 * 8/2013 Apostoloff ..... A41D 3/00 2/93
2014/0373246 A1 * 12/2014 Chapuis ..... A41D 15/04 2/69

(Continued)

*Primary Examiner* — Khaled Annis
(74) *Attorney, Agent, or Firm* — Sanchelima & Associates PA; Christian Sanchelima; Jesus Sanchelima

(57) ABSTRACT

The present invention discloses a multifunctional athletic apparel. The multifunctional athletic apparel comprises a vest garment and a legging. The vest garment is configured to convert between a vest configuration and a bag configuration. An upper edge and a lower edge of the vest garment are fastened one over another via one or more fasteners to form a bag configuration. The upper edge and the lower edge of the vest are unfastened to form the vest configuration. The legging have a tubular body of thigh high length. The tubular body comprises a first end configured to maintain the legging above the knee and the second end configured to grip an ankle area of a wearer. The multifunctional athletic apparel enables users to change clothes by eliminating the need for a dressing room or seclusion.

9 Claims, 4 Drawing Sheets

(56) References Cited

U.S. PATENT DOCUMENTS

| | | | | |
|---|---|---|---|---|
| 2016/0081402 | A1* | 3/2016 | Nixon, Jr. | A41D 1/08<br>2/227 |
| 2017/0231299 | A1* | 8/2017 | Feterman | A45C 3/06<br>224/153 |
| 2018/0168250 | A1* | 6/2018 | Ly | A41D 1/06 |
| 2018/0343941 | A1* | 12/2018 | Arnold | A41D 3/04 |
| 2019/0239582 | A1* | 8/2019 | Koshkaroff | A41D 3/005 |
| 2019/0364993 | A1* | 12/2019 | Arnold | A41D 17/02 |

* cited by examiner

MULTIFUNCTIONAL ATHLETIC APPAREL

BACKGROUND OF THE INVENTION

1. Field of the Invention

The present disclosure relates to apparel. More particularly, the present disclosure relates to multifunctional athletic apparel.

2. Description of the Related Art

Many outdoor activities generally require the use of special clothing to participate. For example, it is typically recommended that runners wear athletic apparel that keeps the runner comfortable. After participating in such activities, one must often change clothing in a public facility or near other people to drive home or engage in other activities such as going to a restaurant or shopping. However, in many instances, public facilities or private changing quarters are not available due to the remoteness of the location or the circumstances of the activity. If no adequate facilities are available, changing clothes without accidentally exposing oneself can be a burdensome task.

A few options for changing clothes without public exposure include changing in a car or finding a secluded place to change. After changing, the removed clothing is stuffed into a bag until it's needed. This type of storage is cumbersome, takes up space, the clothing could easily fall out, get left behind, or become wrinkled. Moreover, many articles of clothing are too large or bulky to even fit inside a bag.

Several devices have been designed in the past. None of them, however, include multifunctional athletic apparel that is capable of addressing the foregoing discussed issues.

Applicant believes that a related reference corresponds to U.S. Pat. No. 7,651,016 filed by Daniel Roy Stewart describes a combination waist pack. Daniel's reference discloses a combination waist pack that could be worn comfortably about the waist and unfolds to provide an accessory such as a seat cushion, water resistant barrier, or padded articles for providing protection to various parts of a person for use in outdoor sports and recreation. The waist pack is converted to a seat or other protective device while unfolded and a warm & protective waistband, hand warmer and padded pack while folded. However, Daniel's reference fails to provide a solution to change clothes in public without exposing the user's body to observers and/or passers-by.

Another related reference is US patent application number 20020095710 filed by Myung-Chun Lee describes a convertible article of clothing. Myung-Chun's reference discloses an article of clothing that could be converted from a vest, to a jacket, to a hooded jacket, to overalls, to a parka or to various types of clothing in between. However, Myung-Chun reference also fails to provide a solution to change clothes in public without exposing the user's body to observers and/or passers-by.

Other documents describing the closest subject matter provide for a number of more or less complicated features that fail to solve the problem in an efficient and economical way. None of these patents suggest the novel features of the present invention.

SUMMARY OF THE INVENTION

It is an object of the present invention to provide a multifunctional athletic apparel.

It is another object of the present invention to provide a multifunctional athletic apparel convertible between a vest configuration and a bag configuration.

It is yet another object of the present invention to provide a multifunctional athletic apparel that enables a user to change clothes without the need for a dressing room or seclusion.

It is yet another object of the present invention to provide a multifunctional athletic apparel having fashion appeal for both men and women.

It is yet another object of the present invention to provide a multifunctional athletic apparel, comprising a vest garment having one or more fasteners, wherein an upper edge and a lower edge of the vest garment are fastened one over another via the fasteners to form a fanny pack configuration, and wherein the upper edge and the lower edge of the vest are unfastened to form the vest configuration.

It is yet another object of the present invention to provide a multifunctional athletic apparel comprising an adjustable belt configured to be worn around the waist of the wearer.

It is yet another object of the present invention to provide a multifunctional athletic apparel comprising a legging having a tubular body of thigh high length.

It is yet another object of the present invention to provide a multifunctional athletic apparel comprising a legging having a zipper fastener.

Further objects of the invention will be brought out in the following part of the specification, wherein detailed description is for the purpose of fully disclosing the invention without placing any limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
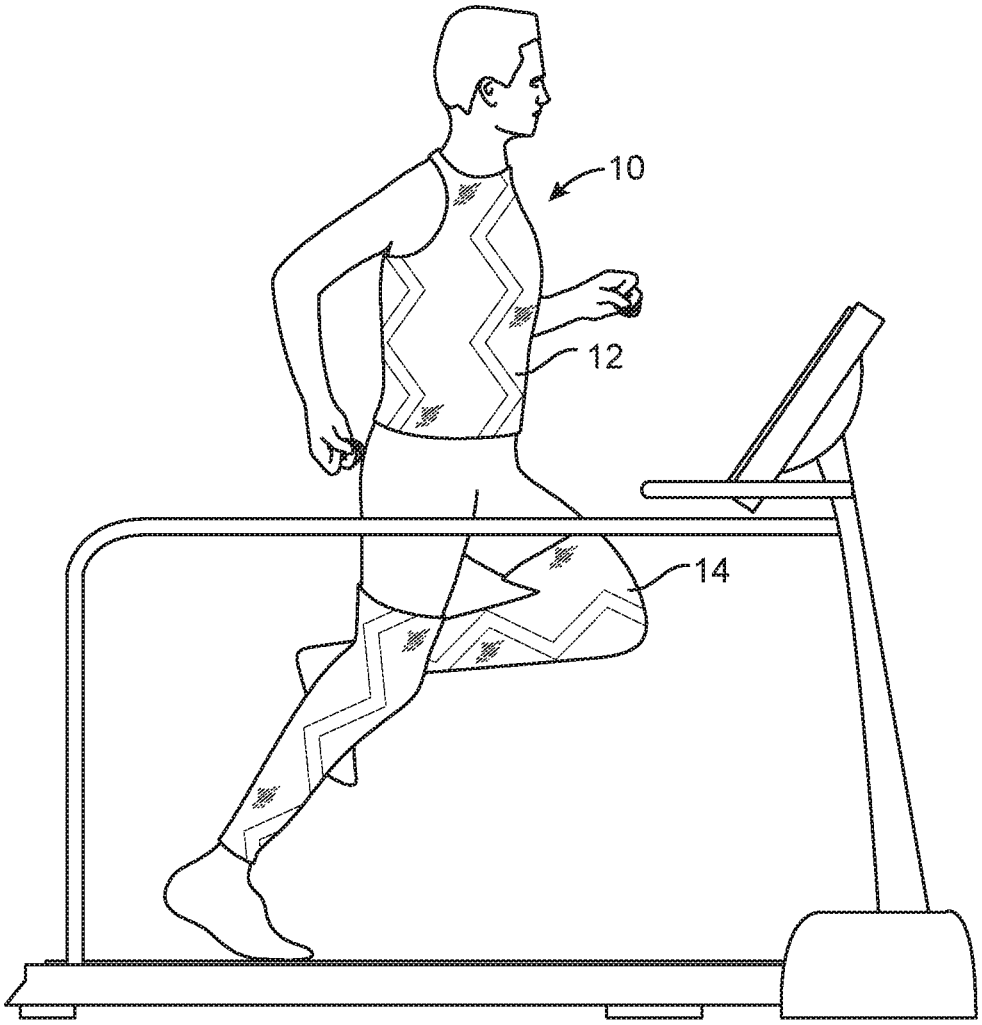
FIG. 1 exemplarily illustrates a user wearing the multifunctional athletic apparel 10 in an embodiment of the present invention.
Figure 2:
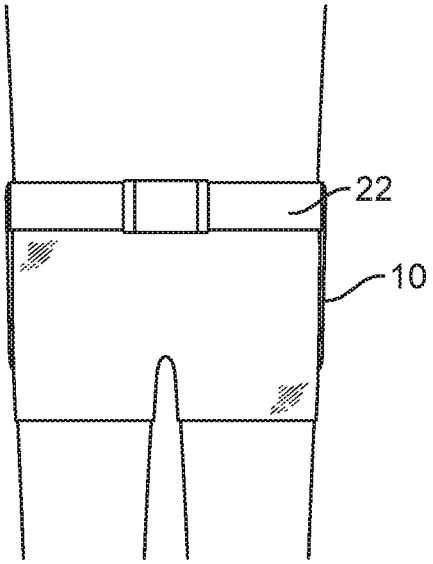
FIG. 2 exemplarily illustrates the user wearing the multifunctional athletic apparel 10 in a fanny pack configuration in an embodiment of the present invention.
Figure 3:
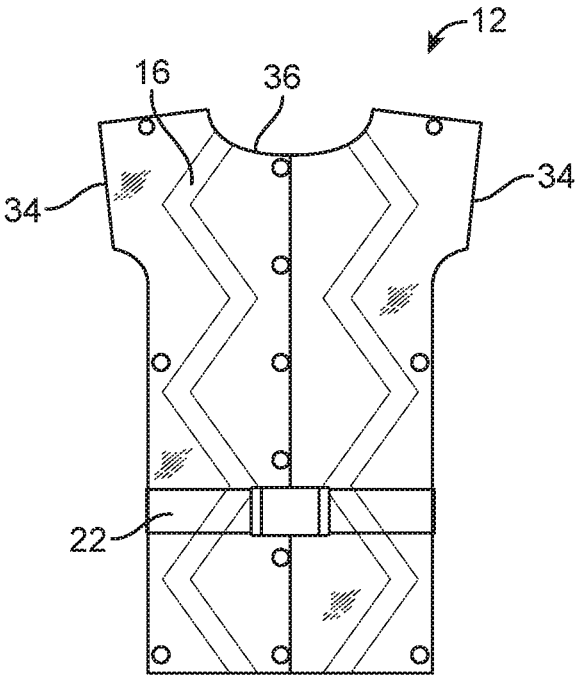
FIG. 3 exemplarily illustrates a front view of a vest garment 12 in an embodiment of the present invention. The vest garment 12 comprising an adjustable belt member 22 is illustrated.
Figure 4:
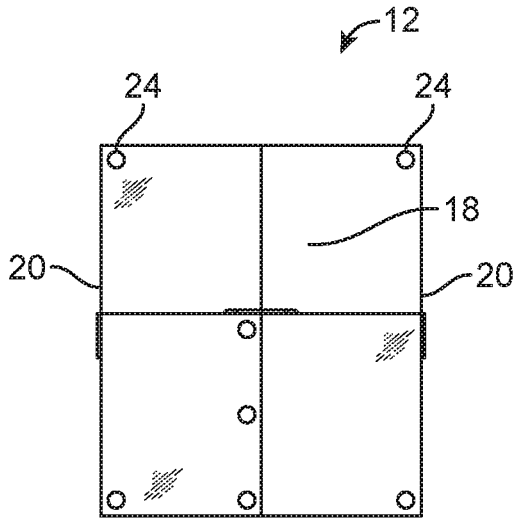
FIG. 4 exemplarily illustrates the fanny pack configuration of the vest garment 12 in open position to receive and store one or more articles in an embodiment of the present invention. The vest garment 12 comprising one or more fasteners 24 is illustrated, FIG. 5 exemplarily illustrates the fanny pack configuration of the vest garment 12 in an embodiment of the present invention. The fanny pack configuration comprising a zipper fastener 26 is illustrated.
Figure 5:
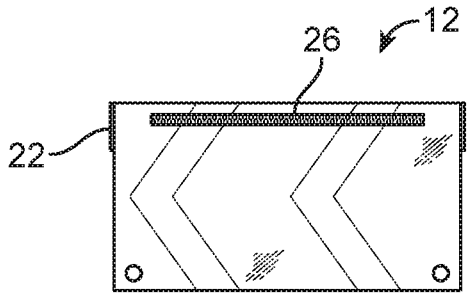
Figure 6:
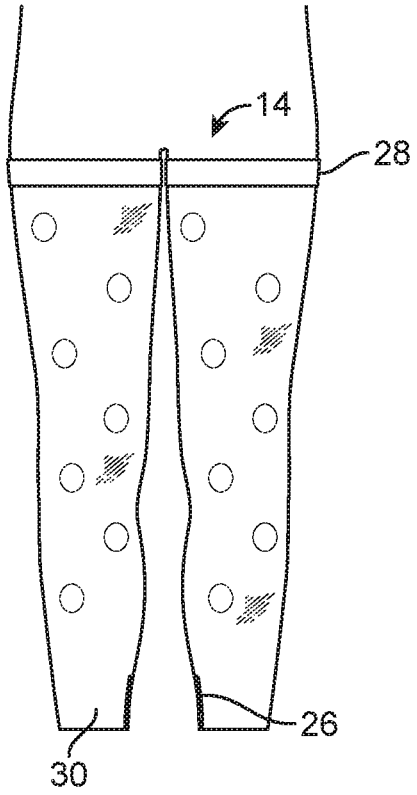
FIG. 6 exemplarily illustrates a front view of a user wearing leggings 14 in an embodiment of the present invention. The legging 14 comprising a first end 28 and a second end 30 with a fastener member 26 is illustrated.
Figure 7:
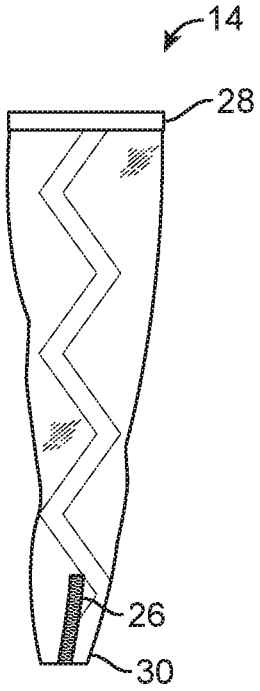
FIG. 7 exemplarily illustrates a side view of the legging 14 in an embodiment of the present invention.

Referring now to the drawings, FIGS. 1-7, where the present invention is generally referred with numeral 10, it can be observed that a multifunctional athletic apparel 10 is disclosed.

The multifunctional athletic apparel 10 comprises a vest garment 12 and a legging 14. The vest garment 12 is configured to convert between a vest configuration and a bag configuration. The vest garment 12 comprises a front panel 16 and a rear panel 18, each having side edges 20. The front 16 and rear panels 18 secured together along the side edges 20 and forms an open-ended torso 36, and a pair of open-ended sleeves 34.

The vest garment 12 comprises an adjustable belt member 22 and one or more fasteners 24. The adjustable belt member 22 is disposed at a middle portion of the vest garment 12 via one or more belt loops. The belt member 22 extends across the side edges 20 at the middle portion of the vest garment 12. In one embodiment, one or more belt loops are attached to an exterior surface at the side edges 20. The belt loops are most preferably attached to the vest garment 12 by stitching. In one embodiment, the belt loops could also be removably attached to the vest garment 12 by snaps, Velcro®, buttons or any other type of fasteners. The fasteners 24 are disposed at the periphery of at least one of the front panel 16 or rear panel 18. In one embodiment, the fasteners 24 could be snaps, Velcro®, buttons or any other type of fasteners.

An upper edge and a lower edge of the vest garment 12 are fastened over one another via the fasteners 24, to form the bag configuration. The bag configuration includes a zipper fastener 26 or any other type of fastener to receive and store one or more articles. In an embodiment, the bag configuration is a fanny pack configuration. In another embodiment, the bag configuration is at least one of a fanny pack, hand pack or backpack configuration. The upper edge and the lower edge of the vest garment 12 are unfastened to form the vest configuration. The adjustable belt member 22 is configured to worn around a waist of the wearer during use of the bag configuration or the vest configuration.

The legging 14 comprises a substantially tubular body to comfortably enclose a wearer's leg. In one embodiment the legging 14 may be made of a flexible material for fitting snugly. The tubular body is sufficiently stretchy to allow for donning and removal as desired. The tubular body comprises a first end 28 configured to maintain the legging 14 above the knee and the second end 30 configured to grip an ankle area of the wearer. The tubular body is of thigh high length that enables to change clothes eliminating the need for a dressing room or seclusion.

In one embodiment, the second end 30 comprises at least one fastener member 26. In one embodiment, the fastener member 26 is a zipper type fastener. In an embodiment, the legging 14 is made from a flexible fabric material for enabling the substantially tubular body to lay comfortably around the wearer's leg. In another embodiment, the legging 14 is made of a material including but not limited to cotton, polyester, or a cotton/polyester blend.

The leggings 14 are preferably body hugging and fitted on the legs like a pair of tights and ideally has one or more zippers that allow the wearer to easily and quickly remove them without removing torso-engaging underwear or pants. The legging 14 could be stored in the bag configuration of the vest garment. In one embodiment, bag configuration of the vest garment provides a convenient place to carry keys, change and other small items.

In one embodiment, the multifunctional athletic apparel 10 is made of a light weight fabric material for use in hot climates. In another embodiment, the multifunctional athletic apparel 10 is made of a heavy weight fabric material for use in cool environments. In yet another embodiment, the multifunctional athletic apparel 10 is made of at least one of a material including but not limited to spandex, cotton and velour.

In one embodiment, the vest garment 12 and legging 14 could be manufactured in different color and print configuration. In another embodiment, the vest garment 12 and legging 14 could be manufactured in matching color and print configuration. In yet another embodiment, the multifunctional athletic apparel 10 could be manufactured in any size. In yet another embodiment, the dimension, color, material, density of the multifunctional athletic apparel 10 may vary according to the preference of the end user Advantageously, the multifunctional athletic apparel 10 enables users to change clothes by eliminating the need for a dressing room or seclusion. The multifunctional athletic apparel 10 has a fashion appeal for both men and women. The multifunctional athletic apparel 10 could be easily collapsed into the fanny pack configuration and worn around the wearer's waist. This facilitates the wearer to carry the multifunctional athletic apparel 10 in a hands-free manner. The multifunctional athletic apparel 10 further enables to store one or more portable article. The multifunctional athletic apparel 10 could be used by anyone engaged in outdoor activities.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A multifunctional athletic apparel, comprising:

a shirt garment configured to convert between a shirt configuration and a bag pack configuration, wherein said shirt garment comprises an adjustable belt member disposed at a middle portion of said shirt garment, wherein an upper edge and a lower edge of said shirt garment are fastened one over another via one or more fasteners to form said bag pack configuration, said pack configuration including a rectangular pouch, the rectangular pouch having a front face with at least two fasteners located on opposing bottom corners of said front face, said rectangular pouch including a zipper located at a top portion of said front face, the zipper providing access to an interior of the rectangular pouch for items to be stored therein, said belt member abuttingly engaged with lateral sides of the rectangular pouch, the belt member being flush with a top edge of said rectangular pouch, wherein said upper edge and said lower edge of said shirt garment are unfastened to form said shirt configuration; and a legging comprising a tubular body configured to enclose a wearer's leg up to a predetermined length above the knee, said legging including a zipper perpendicular to a bottom edge.

2. The athletic apparel of claim 1, wherein said shirt garment comprises a front panel and a rear panel, each having side edges.

3. The athletic apparel of claim 2, wherein the front and rear panels secured together along the side edges and forms an open-ended torso, and a pair of open-ended sleeveless portions.

4. The athletic apparel of claim 1, wherein said one or more fasteners are disposed at a periphery of the front panel.

5. The athletic apparel of claim 1, wherein said legging is made of a flexible material for fitting snugly around the wearer's leg.

6. The athletic apparel of claim 1, wherein said adjustable belt member is configured to be worn around a waist of the wearer while using said shirt configuration.

7. The athletic apparel of claim 1, wherein said adjustable belt member is configured to be worn around the waist of the wearer while using the bag pack configuration.

8. The athletic apparel of claim 1, wherein said shirt garment is sleeveless.

9. A multifunctional athletic apparel, consisting of:

a. a shirt garment configured to convert between a shirt configuration and a pack configuration, wherein said shirt garment comprises an adjustable belt member disposed at a middle portion of said shirt garment, wherein an upper edge and a lower edge of said shirt garment are fastened one over another via one or more fasteners to form said pack configuration, said pack configuration including a rectangular pouch, the rectangular pouch having a front face with two fasteners located on opposing bottom corners of said front face, said rectangular pouch including a zipper located at a top portion of said front face, the zipper providing access to an interior of the rectangular pouch for items to be stored therein, said belt member abuttingly engaged with lateral sides of the rectangular pouch, the belt member being flush with a top edge of said rectangular pouch, wherein said upper edge and said lower edge of said shirt garment are unfastened to form said shirt configuration; and b. a pair of leggings including a first legging and a second legging, the first legging and the second legging being separate, wherein said pair of leggings have a tubular body configured to enclose a wearer's leg up to a predetermined length above the knee, said legging including a zipper perpendicular to an interior bottom edge.

* * * * *